United States Patent [19]

Klugmann

[11] Patent Number: 5,052,070

[45] Date of Patent: Oct. 1, 1991

[54] HAIRBRUSH

[75] Inventor: Julius Klugmann, New York, N.Y.

[73] Assignee: Alkinco (Alfred Klugmann International Corporation), New York, N.Y.

[21] Appl. No.: 246,617

[22] Filed: Sep. 20, 1988

[51] Int. Cl.[5] ..... A46B 9/02

[52] U.S. Cl. ..... 15/159 A; 15/186; 15/160

[58] Field of Search ..... 15/159 A, 159 R, 186, 15/187, 192, 160, 167.1; 132/126, 137, 141, 142; 134/6

[56] References Cited

U.S. PATENT DOCUMENTS

| | | | |
|---|---|---|---|
| 1,670,161 | 5/1928 | Meyer | 132/137 |
| 1,847,668 | 3/1932 | Reh | 15/159 R |
| 1,921,328 | 8/1933 | Shaw | 132/141 |
| 2,207,157 | 7/1940 | Neville et al. | 15/159 A |
| 2,225,331 | 12/1940 | Campbell | 15/188 |
| 2,273,717 | 2/1942 | Millard et al. | 15/167.1 |
| 2,888,698 | 6/1959 | Kaye et al. | 15/184 |
| 2,889,567 | 6/1959 | Solomon | 15/114 |
| 2,963,729 | 12/1960 | Thonbo et al. | 15/187 |
| 3,133,546 | 5/1964 | Dent | 15/159 A |
| 3,153,800 | 10/1964 | Trotin | 15/159 A |
| 3,186,018 | 6/1965 | Shaw | 15/159 A |
| 3,256,545 | 6/1966 | Lewis et al. | 15/159 A |
| 3,402,416 | 9/1968 | Shaw et al. | 15/159 A |
| 3,843,990 | 10/1974 | Lardenois | 15/159 R |
| 4,196,489 | 4/1980 | Hahn | 15/159 R |
| 4,197,608 | 4/1980 | Holley et al. | 15/27 |
| 4,288,883 | 9/1981 | Dolinsky | 15/110 |
| 4,307,478 | 12/1981 | Ward et al. | 15/159 A |
| 4,325,392 | 4/1982 | Iten et al. | 132/80 R |

FOREIGN PATENT DOCUMENTS

| | | | |
|---|---|---|---|
| 632357 | 6/1936 | Fed. Rep. of Germany | |
| 1253229 | 11/1967 | Fed. Rep. of Germany | 15/159 R |
| 197802 | 2/1978 | France | |
| 333001 | 3/1959 | Switzerland | |

*Primary Examiner*—Philip H. Coe
*Assistant Examiner*—Mark Spisich
*Attorney, Agent, or Firm*—Sandler, Greenblum & Bernstein

[57] ABSTRACT

A brush constructed to minimize hair loss and removal. The brush has flexible bristles tapering from a base diameter of about 0.003 mm to about 0.007 mm. to a working diameter of about 0.001 mm to about 0.004 mm, and to a length of approximately 1.75 inches to 2.25 inches.

5 Claims, 1 Drawing Sheet

HAIRBRUSH

BACKGROUND OF THE INVENTION

1. Field of the Invention

The present invention relates to a hairbrush which, while having the ability to brush hair, will not contribute to hair loss and will have a reduced tendency to catch 2. Description of Background and Relevant Information While brushes and the like are a fixture of virtually every household, such brushes often have an undesirable tendency to cause increased or aggravated hair loss, catch and hold already loose hairs in their bristles, and tear weakened hairs.

Many hairbrush users have a heightened concern as to the consequences of these undesirable tendencies. In particular, people who are balding, ill and/or aging are very sensitive about hair loss, especially when such hair loss is increased or aggravated by the use of a brush. Moreover, certain religious customs prohibit the use of a brush on the Sabbath when that brush may have a tendency to remove/tear hair during brushing of the head or beard.

The bristles that are utilized in conventional hairbrushes, especially natural bristles, generally have a tapered appearance, tapering from a thicker, stiff end to a thin, flexible end. Ordinarily, in conventional hairbrushes, the thicker end of the bristle is utilized to a greater extent in the brushing area in order to achieve an increased stiffness. As a matter of fact, brushes produced from very stiff bristles are usually higher priced than those made from flexible bristles.

In the typical hairbrush, the bristles& are positioned so that most of the bristles have their thick, stiff ends located at the periphery of the hairbrush, i.e., that area of the brush which contains the free ends of the bristles. This typical hairbrush construction is illustrated in FIG. 1, wherein bristles 1 are mounted in the base 2 in such a manner whereby the thicker ends 3 at the periphery of the hairbrush greatly exceed the thinner ends 4.

U.S. Pat. No. 3,153,800 discloses a brush, particularly a hairbrush. FIG. 1 of the patent illustrates groups of bristles whose arrangements of bristles randomly vary in the orientation of their taper. The patent discloses that bristles are tapered according to known processes before or after being mounted such as by means of a device comprising a blade rotating at high velocity and with the aid of needles which are adapted to strike the ends of bristles.

U.S. Pat. No. 4,196,489 is directed to a hairbrush which is stated to have a low tendency to engage hairs and pull them from the scalp. The bristles are arranged on a brush. Outstanding ribs prevent loosened hairs from accumulating at the base of the bristles.

U.S. Pat. No. 3,186,018 discloses a brush construction for use in paint brushes and other uses in which hog bristles are utilized which possess a diameter reduced in the direction of the working or painting end. The patent states that the decrease in stiffness in the direction of the working end is highly desirable because of the flexing imparted to the brush. At the working end of the bristles, the bristles split into a multiplicity of finer filaments which facilitates smooth application of paint or liquids.

U.S. Pat. No. 3,256,545 discloses brush fibers having a uniform taper imparted to them with reduced diameter working tips and course bases. The patent states that it is an object of the invention to provide brush fibers which provide longer service than other brush fibers which do not have their maximum percentage of material mass arranged at or near their working tips.

SUMMARY OF THE INVENTION

Accordingly, it is an object of the present invention to provide a brush that will not contribute to hair loss and will have a reduced tendency to catch and/or tear hair during brushing.

These and other objects of the invention are achieved by virtue of the hairbrush of the invention, which hairbrush includes a base for holding hair bristles and flexible tapered bristles having thick, stiff ends having a diameter of approximately 0.003 to 0.007 mm. which taper to thin, flexible ends having a diameter of approximate 0.001 to 0.004 mm. The bristles, which are preferably natural hog bristles, are mounted in the base with the thick, stiff ends being held in the base, and the thin, flexible ends being outwardly directed. The bristles have a length of approximately 1.75 to 2.25 inches from the base. The hairbrush in accordance with the present invention can have an oval base which is approximately 3 inches by 4.5 inches. The flexible bristles can be grouped in groupings. These groupings can be spaced about 1 cm. apart. Preferably, the hairbrush contains approximately 75–80 groupings, and most preferably approximately 80 groupings.

Another object of the invention is to provide a method for brushing hair with reduced hair loss and tearing. In this method of brushing, the hair is brushed with a hairbrush having flexible tapered bristles having thick, stiff ends which taper to thin, flexible ends. The bristles are mounted whereby their thin, flexible ends contact the hair. The length of the bristles and the taper are correlated to each other to obtain a desired flexibility to achieve the reduced hair loss and tearing.

In this regard, the thick, stiff bristle ends preferably have a diameter of approximately 0.003 to 0.007 mm., the thin, flexible bristle ends preferably have a diameter of approximately 0.001 to 0.004 mm., and the bristles preferably have a length of approximately 1.75 to 2.25 inches. In accordance with the preferred method of brushing, the bristles are grouped in groupings. These groupings are preferably spaced about 1 cm. apart, and the brush preferably contains about 75–80 groupings, and most preferably approximately 80 groupings.

The hair that is being brushed can be the hair that is on top of the head, as well as facial hair.

BRIEF DESCRIPTION OF DRAWINGS

The invention will now be described with reference to non-limiting examples demonstrating the present invention, with reference to the annexed drawing, in which.

DESCRIPTIONS OF PREFERRED EMBODIMENTS

Figure 1:
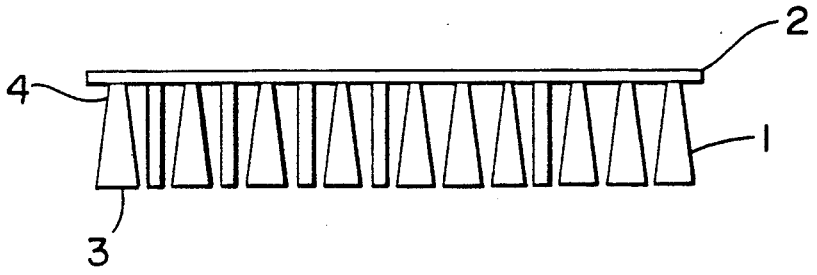
Fig- 1 PRIOR ART
FIG. 1 illustrates the prior art wherein the majority of the bristles are oriented with the thick portion oriented outwardly.
Figure 2:
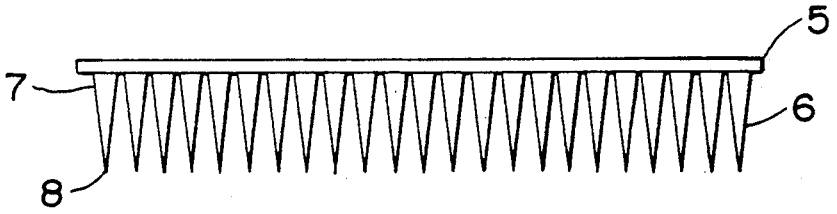
FIG. 2 illustrates the brush according to the invention wherein the bristles are oriented with their tapered ends outward.

As illustrated in FIG. 2, the hairbrush according to the invention, is formed of bristles 6 whose diameters taper from a thick end 7 mounted in the base 5 to a thin, working end 8.

The bristles have a base diameter which ranges from about 0.003 mm. to about 0.007 mm. and taper to a diameter at their working end of to about 0.001 mm. to about 0.004 mm. The length of the brush bristles ranges from approximately 1.75 inches to about 2.25 inches.

The bristles utilized in the hairbrush according to the present invention, unlike many conventional hairbrushes which are produced from particularly stiff bristles, have a natural tendency to bend or flex. The preferred bristles are natural hog bristles.

In contrast to the stiff bristle design of conventional hairbrushes which tends to pull out and retain hair, this cannot happen with the hairbrush of the instant invention. Indeed, by varying the length of the bristles, while utilizing the taper of the instant invention, it is possible to virtually eliminate undesired hair removal by the hairbrush. In particular, the longer the bristles, the more the bend or flex, and the less hair loss. In this regard, the length of the bristle can be varied depending upon the specific user. For example, the length of the bristle can be constructed so that individuals with unusual hair problems or those with a tendency to loose hair would utilize a hairbrush having a longer bristle.

The brushes may be made either by inserting bristles of the desired length and tapers directly into the brush base, which may be made of wood or plastic, or by modifying existing brushes for purposes of the invention. Preferably, the brush base may be oval shaped having dimensions of 3 inches and 4.5 inches.

Thus, it has been found that brushes which are presently commercially available for purposes of brushing hair or dust off of people or clothing may be modified to provide a brush according to the invention by cutting down the bristles to a length of about 2 to 3 inches, with a post treatment of the working ends of the bristles to smooth them but. This post treatment consists essentially of the removal of heavy ends, and sanding, trimming and polishing.

Although the invention has been described with reference to particular means, materials and embodiments, it is to be understood that the invention is not limited to the particulars disclosed and extends to all equivalents within the scope of the claims.

What is claimed is:

1. A hairbrush having a reduced tendency to tear and remove hair during brushing comprising:

a base for holding bristles;

flexible, uniformly tapered natural hog bristles with each bristle having thick, stiff end having a diameter of approximately 0.003 to 0.007 mm. which tapers to a thin, flexible end having a diameter of approximately 0.001 to 0.004 mm., wherein the natural hog bristles are mounted in the base with the thick, stiff ends being held in the base, and the thin, flexible ends being outwardly directed; and each bristle having a length of approximately 1.75 to 2.25 inches from the base, whereby the hairbrush has a reduced tendency to tear and remove hair during brushing.

2. The hairbrush according to claim 1, wherein the bristles are grouped in a plurality of groupings.

3. The hairbrush according to claim 2, wherein the groupings are spaced about 1 cm. apart.

4. The hairbrush according to claim 3, wherein there are approximately 75–80 groupings on the hairbrush.

5. The hairbrush according to claim 1, wherein the base is oval and approximately 3 inches by 4.5 inches.

* * * * *